US010626002B2

(12) United States Patent
Habersetzer et al.

(10) Patent No.: US 10,626,002 B2
(45) Date of Patent: Apr. 21, 2020

(54) METHOD AND DEVICE FOR FILLING A CONTAINER TO BE FILLED WITH A FILLING PRODUCT

(71) Applicant: KRONES AG, Neutraubling (DE)

(72) Inventors: Florian Habersetzer, Neutraubling (DE); Josef Knott, Neutraubling (DE); Christian Stoiber, Neutraubling (DE); Holger Mueller, Neutraubling (DE)

(73) Assignee: KRONES AG, Neutraubling (DE)

( * ) Notice: Subject to any disclaimer, the term of this patent is extended or adjusted under 35 U.S.C. 154(b) by 25 days.

(21) Appl. No.: 16/153,621

(22) Filed: Oct. 5, 2018

(65) Prior Publication Data

US 2019/0106311 A1 Apr. 11, 2019

(30) Foreign Application Priority Data

Oct. 6, 2017 (DE) ..... 10 2017 123 253

(51) Int. Cl.

| | |
|---|---|
| ***B67C 3/12*** | (2006.01) |
| ***B67C 3/26*** | (2006.01) |
| ***B67C 3/10*** | (2006.01) |
| ***B67C 3/08*** | (2006.01) |
| ***B67C 7/00*** | (2006.01) |

(52) U.S. Cl.

CPC ..... *B67C 3/10* (2013.01); *B67C 3/08* (2013.01); *B67C 3/12* (2013.01); *B67C 3/2614* (2013.01); *B67C 7/00* (2013.01); *B67C 2003/2691* (2013.01); *B67C 2003/2697* (2013.01); *B67C 2007/0066* (2013.01)

(58) Field of Classification Search

CPC .... B67C 3/10; B67C 3/08; B67C 7/00; B67C 3/2614; B67C 3/12; B67C 2007/0066; B67C 2003/2697; B67C 2003/2691; B67C 3/22; B67C 3/02

See application file for complete search history.

(56) References Cited

FOREIGN PATENT DOCUMENTS

| | | |
|---|---|---|
| DE | 19538023 | 4/1996 |
| EP | 0554690 | 8/1993 |
| EP | 2937310 | 10/2015 |
| WO | WO 2015/028249 | 3/2015 |
| WO | WO 2017/025289 | 2/2017 |

OTHER PUBLICATIONS

Office Action in related European Patent Application No. 18198925.2, dated Mar. 21, 2019, 7 pages.

*Primary Examiner* — Mary E McManmon
*Assistant Examiner* — Jason K Niesz
(74) *Attorney, Agent, or Firm* — Haynes and Boone, LLP

(57) ABSTRACT

A method for filling a container to be filled with a filling product includes accommodating a container to be filled in a treatment chamber, sealing a filling device to the container, rinsing the container with a rinsing gas introduced into the container through a rinsing gas channel, filling the container with the filling product, pre-pressurizing the treatment chamber with a pressurization gas through a pressurization gas channel, removing the filling device from the container, closing the container with a container closure, relieving the pre-pressurization pressure in the treatment chamber, and removing the container from the treatment chamber. The pre-pressurization pressure that is present in the treatment chamber is at least in part relieved into the rinsing gas channel.

20 Claims, 3 Drawing Sheets

METHOD AND DEVICE FOR FILLING A CONTAINER TO BE FILLED WITH A FILLING PRODUCT

CROSS REFERENCE TO RELATED APPLICATIONS

This application claims priority from German Patent Application No. DE 10 2017 123 253.2, filed on Oct. 6, 2017 in the German Patent and Trademark Office, the disclosure of which is incorporated herein by reference in its entirety.

BACKGROUND

Technical Field

The present invention relates to a method and a device for filling a container to be filled with a filling product, for example in a beverage filling plant.

Related Art

Filling methods are known, and devices for carrying out a filling method are known, in which a container that is to be filled is sealed off by means of a treatment chamber, a filling valve is connected with the mouth of the container to be filled, and the interior of the container to be filled is rinsed with a rinsing gas in order to reduce its oxygen content. After the rinsing of the interior of the container with the rinsing gas, the interior of the container is filled with the filling product. Prior to the filling, and depending on the chosen filling procedure and the filling product with which the container is to be filled, the container to be filled may also be pre-pressurized or evacuated.

At the same time as the interior of the container is filled with the filling product, or else prior to or subsequent to this, an overpressure is applied to the interior of the container, and the filling valve is then removed from the mouth of the container, which has already been filled with the filling product. Due to the overpressure which is present in the treatment chamber, the filling product, in particular in the case of a carbonated filling product, does not overflow, spurt out or foam over when the filling valve is removed from the mouth of the container which has been filled with the filling product. The treatment chamber, which is at an overpressure, thereby communicates with the interior of the container.

In a next treatment step, in the treatment chamber, which is still at an overpressure, a container closure is attached to the container, and the container is thereby closed. Subsequently, the overpressure that is present in the treatment chamber is reduced, substantially to the ambient pressure, and the filled and closed container is then removed from the treatment chamber. Such a device, and such a method, are known for example from EP 2 937 310 A2.

SUMMARY

A method for filling a container to be filled with a filling product is described. The method includes sealing the accommodation of the container to be filled in a treatment chamber, sealing the filling device to the container, subsequent to the sealing of the filling device to the container, rinsing the container with a rinsing gas introduced into the container through a rinsing gas channel, subsequent to the rinsing of the container with the rinsing gas, filling the container with the filling product, pre-pressurizing the treatment chamber with a pressurization gas through a pressurization gas channel, subsequent to the filling of the container and the pre-pressurization of the treatment chamber, removing the filling device from the container, subsequent to the removal of the filling device from the container, closing with a container closure the container which is accommodated in the treatment chamber, and subsequent to the closing of the container, relieving of the pre-pressurization pressure in the treatment chamber and removing the container from the treatment chamber. The pre-pressurization pressure that is present in the treatment chamber is at least in part relieved into the rinsing gas channel.

Due to the fact that the relief of the pre-pressurization pressure in the treatment chamber is at least in part achieved via the rinsing gas channel, reuse of the gas that is used in the treatment chamber for pre-pressurization is made possible. In particular, the pressurization gas that is used in the treatment chamber can be used subsequently to rinse a further container that is to be filled.

In particular, due to the pressure differences, it is not necessary, when rinsing the container with the rinsing gas prior to the actual filling of the container with the filling product, to carry out the rinsing at a high pressure. Instead, the rinsing is generally carried out at a pressure that is below the pressure of the filling product. By way of example, rinsing can be carried out with a rinsing gas at a low pressure, for example 0.5 bar to 4 bar absolute pressure, for example at an absolute pressure of 1.4 bar to 1.9 bar, wherein the container is at the same time in communication, via a vacuum channel, with an underpressure which is below the pressure of the rinsing gas. Accordingly, the rinsing gas is, as it were, sucked out of the rinsing gas channel through the container that is to be rinsed.

The term "vacuum" in "vacuum channel" is to be understood in this context only in the sense that the pressure in the vacuum channel during the rinsing of the container with the rinsing gas is below the pressure that is present in the rinsing gas channel, in order thereby to achieve a flow of rinsing gas from the rinsing gas channel into and through the container.

In contrast, in order to provide an appropriate counterpressure to prevent the release of gas from a carbonated filling product, the treatment chamber is pressurized with the pressurization gas to an absolute pressure of 2 bar to 11 bar, for example to an absolute pressure of 5 bar to 9 bar. By means of the pressurization of the treatment chamber with the pressurization gas, it can be achieved in particular that a carbonated filling product does not tend to release the bound $CO_2$ in the filling product when the filling device is removed from the mouth of the filled container.

By this means it can thus be achieved that the tendency of the filling product in the container to foam, or any foaming up and escaping from the mouth of the filled container, is suppressed by the pre-pressure in the treatment chamber. Furthermore, any foam that may be present in the mouth area of the filled container will be pushed back into the filled container due to the overpressure in the treatment chamber. This overpressure in the treatment chamber is maintained until the container has been securely closed with a container closure by means of the capper.

In order efficiently to achieve both the rinsing effect of the rinsing gas and the pre-pressurization effect of the pressurization gas, the pressurization gas channel is additionally at a higher pressure than the rinsing gas channel. By this means it is also ensured that, when a rinsing gas valve is opened, at least a portion of the pressurization gas flows from the treatment chamber, which is pressurized with the pressurization gas, into the rinsing gas channel.

It can thereby be achieved that a portion of the gas volume of the pressurization gas, which is present at a high pressure in the treatment chamber for the purpose of pre-pressurization, is introduced into the rinsing gas channel after the container has been closed, in order to relieve the pressure in the treatment chamber. The pressure in the rinsing gas channel is lower, with the result that a significant portion of the gas volume in the treatment chamber can flow out into the rinsing gas channel. This gas volume can subsequently be reused to rinse the next container that is to be rinsed.

In this context it is to be noted that containers are rinsed with rinsing gas which has, for example, twice the volume of the container. In contrast, the treatment chamber typically has a significantly lower volume that that of the containers.

In an exemplary embodiment, the treatment chamber has a volume of 100 ml, while a container to be filled has a volume of 500 ml to 1 L. As a result, with an absolute pressure of 5 bar in the treatment chamber, which is pre-pressurized by the pressurization gas from the pressurization gas channel, and an absolute pressure of 1 bar in the rinsing gas channel, when the next container to be filled is rinsed the entire volume of pressurization gas from the treatment chamber that has flowed back into the rinsing gas channel to relieve the pressure is used in the container to be rinsed. Subsequently, this is replenished by fresh rinsing gas from a rinsing gas reservoir.

In this manner a reduction can be achieved in the quantities of pressurization gas and rinsing gas, both of which are usually $CO_2$, that are consumed. This is because the $CO_2$ that is used as pressurization gas in the treatment chamber can subsequently be recycled as rinsing gas. Accordingly, there is a recycling rate of approximately 80% of the $CO_2$ that is used as pressurization gas in the treatment chamber.

In several embodiments, subsequent to the relief of the pre-pressurization pressure into the rinsing gas channel, the residual pre-pressurization pressure in the treatment chamber is further relieved, for example to ambient pressure, through a pressure relief channel that is in communication with the environment. In this manner it can be ensured that, before the filled and closed container is removed from the treatment chamber, the pressure in the treatment chamber is further relieved, and thus it is possible to open the treatment chamber safely and remove the container safely.

In various embodiments, subsequent to the removal of the closed container, the rinsing with the rinsing gas of a subsequent container to be filled that is accommodated in the treatment chamber is carried out at least in part with the pressurization gas that has been relieved into the rinsing gas channel. By this means an efficient reuse of the gas can be achieved.

In various embodiments, for rinsing the container, in addition to the pressurization gas that has been relieved into the rinsing gas channel, a rinsing gas from a rinsing gas source is used. By this means the inflow of fresh rinsing gas can be ensured.

In several embodiments, the rinsing gas channel is at an absolute pressure of 0.5 bar to 4 bar, for example at an absolute pressure of 1.4 bar to 1.9 bar, and the pressurization gas channel is at an absolute pressure of 2 bar to 11 bar, for example at an absolute pressure of 5 bar to 9 bar.

In some embodiments, subsequent to the relief of the pre-pressurization pressure that is present in the treatment chamber into the rinsing gas channel, the residual pre-pressurization pressure in the treatment chamber is further relieved, for example to ambient pressure, by means of underpressure provided via a vacuum line. The connection of the treatment chamber with the vacuum line makes it possible to provide very rapid pressure relief.

In certain embodiments, subsequent to the relief of the pre-pressurization pressure that is present in the treatment chamber into the rinsing gas channel, the residual pre-pressurization pressure in the treatment chamber is further relieved, for example to ambient pressure, by means of withdrawal of the filling device and/or a closing device from the treatment chamber.

Thus by means of the increase in the volume of the treatment chamber associated with the withdrawal of the filling device and/or the closing device, a reduction in the residual pre-pressurization pressure in the treatment chamber can be achieved, so that the provision of a pressure relief line can be dispensed with.

The withdrawal of the filling device following the partial relief of the pre-pressurization pressure into the rinsing gas channel is necessary in any event in order to restore the treatment chamber to its initial position and prepare it to accommodate a new container that is to be filled. In this process, the specified relief of pressure in the treatment chamber is also carried out.

In some embodiments, during the introduction of the rinsing gas into the container to be filled, the container to be filled is subjected to an underpressure provided via a vacuum line, generally in order to provide a flow of rinsing gas in the container to be filled. This enables efficient rinsing of the container.

Generally, prior to the introduction of the filling product into the container to be filled, an underpressure is applied to the container to be filled, and a filling product at an overpressure is introduced into the container which is at an underpressure.

A device for filling a container to be filled with a filling product is proposed, which includes a treatment chamber for accommodating the container to be filled in a sealing manner, a filling device for application in a sealing manner to the container that is sealed with the treatment chamber and for introducing a filling product into the container, a rinsing gas channel for introducing a rinsing gas into the container to be filled, a pressurization gas channel for introducing a pressurization gas into the treatment chamber, and a closing device for attaching a container closure to a filled container inside the treatment chamber. A control system is provided, which is configured to relieve at least partially the pre-pressurization pressure in the treatment chamber into the rinsing gas channel subsequent to the closing of the container.

By means of this device, the advantages described above in reference to the method can be achieved.

The control system is generally configured such that, subsequent to the relief of the pre-pressurization pressure in the treatment chamber into the rinsing gas channel, it further relieves the residual pre-pressurization pressure in the treatment chamber, for example to ambient pressure, through a pressure relief channel that is in communication with the environment.

In an advantageous further development, the control system is configured such that, subsequent to the relief of the pre-pressurization pressure in the treatment chamber into the rinsing gas channel, it further relieves the residual pre-pressurization pressure in the treatment chamber, for example to ambient pressure, by means of an underpressure provided via a vacuum line.

In an additional advantageous further development, the control system is configured such that, subsequent to the relief of the pre-pressurization pressure in the treatment chamber into the rinsing gas channel, it further relieves the residual pre-pressurization pressure in the treatment chamber, for example to ambient pressure, by means of withdrawal of the filling device and/or the closing device from the treatment chamber.

The control system is generally configured such that, subsequent to the removal of the closed container, the rinsing of a subsequent container to be filled that is accommodated in the treatment chamber is carried out at least in part with the pressurization gas that has been relieved into the rinsing gas channel.

The control system is advantageously configured to use, for rinsing the container, a rinsing gas from a rinsing gas source in addition to the pressurization gas that has been relieved into the rinsing gas channel.

BRIEF DESCRIPTION OF THE FIGURES

Further embodiments of the invention are more fully explained by the description below of the figures.

DETAILED DESCRIPTION

Figure 1:
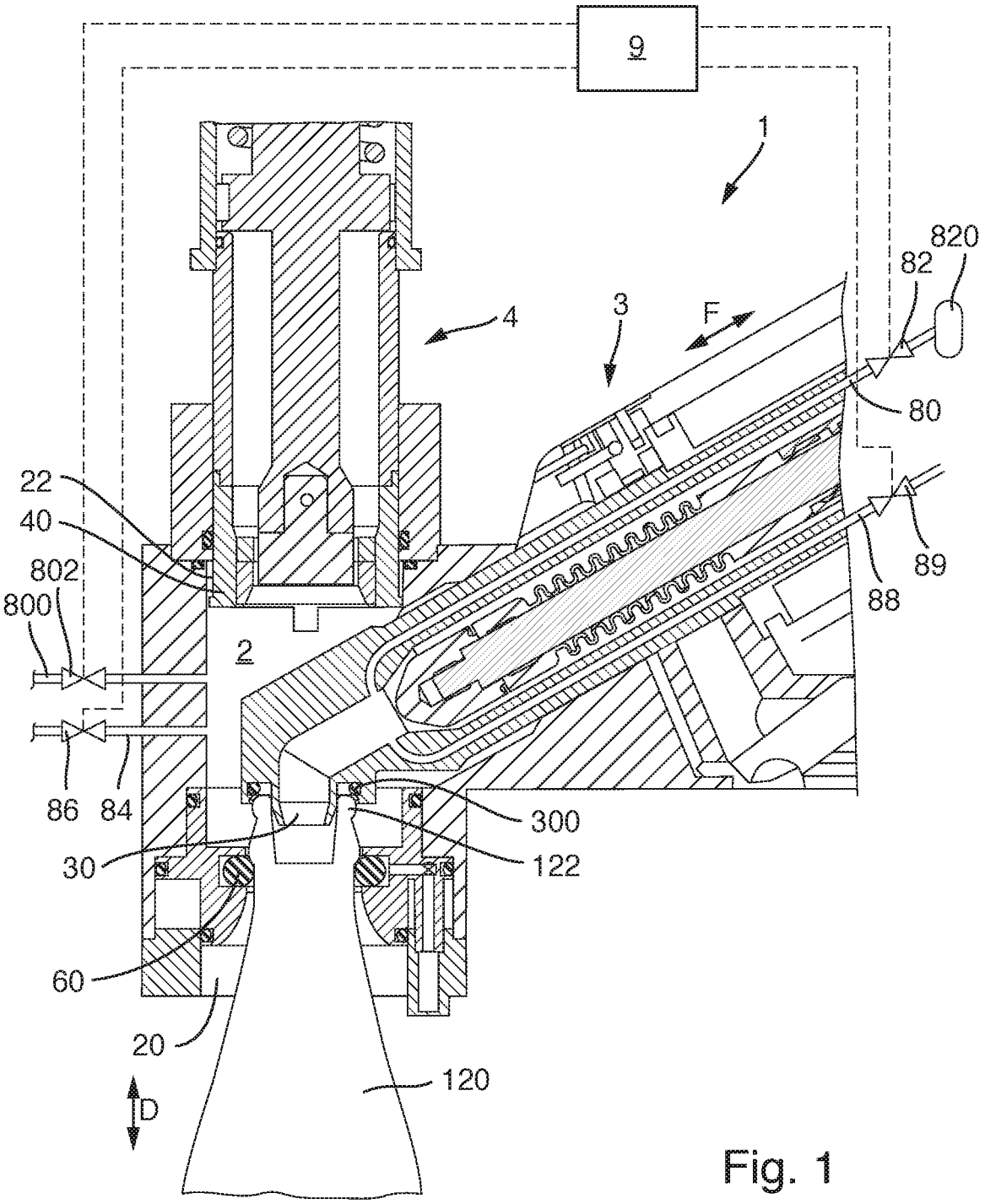
FIG. 1 is a schematic sectional representation of a device for filling a container with a filling product and subsequently closing the container with a container closure, wherein a treatment chamber for accommodating the container, a filling device acting on the container accommodated in the treatment chamber, and a closing element acting on the container accommodated in the treatment chamber are provided.

Examples of embodiments are described below with the aid of the figures. In the figures, elements which are identical or similar, or have identical effects, are designated in the individual figures with identical reference signs. In order to avoid redundancy, repeated description of these elements is in part dispensed with.

The figures show schematically various sections, details and operating states of a device 1 for filling a container 120 with a filling product, and for subsequently closing the container 120, which has been filled with the filling product, with a container closure.

The device 1 includes a treatment chamber 2, a filling device 3 and a closing device 4, which will be described in detail below.

The treatment chamber 2 serves to provide predetermined pressure conditions and/or a predetermined atmosphere for the container 120 that is to be filled, or for the interior of the container 120, when the mouth 122 of the container 120 to be filled is in communication with the treatment chamber 2.

The filling device 3 serves to fill, in a manner which is known, the interior of the container 120 that is to be filled with a predetermined amount of filling product.

Finally, the closing device 4 serves to close, with a container closure, the container 120 that is filled with the filling product.

The device 1 can for example be provided in a beverage filling plant, wherein a beverage bottle that is to be filled is filled with a beverage, and the beverage bottle is closed with a container closure after being filled with the beverage. Other plants for filling different filling products are, however, also envisaged, for example in the fields of foodstuffs, pharmaceuticals, hygiene or mineral oil.

It is usual in such a plant that a plurality of the devices 1 that are shown are disposed around the periphery of a treatment carousel. The devices 1 thus circulate about the axis of rotation of the treatment carousel, in order by this means to provide continuous processing, and in particular continuous filling and continuous closing, of continuously supplied containers 120 that are to be filled, for example in a beverage filling plant. A stream of filled and closed containers 120 is thereby produced.

The treatment chamber 2 of each device 1 is provided to accommodate at least a portion of the container 120 to be filled. For this purpose the treatment chamber 2 has at its lower end a container accommodation aperture 20, through which the container 120 that is in each case to be filled can be pushed into the treatment chamber 2 with its container mouth 122 foremost.

By means of the introduction of the container 120 to be filled, with its container mouth 122, into the treatment chamber 2, the container accommodation aperture 20 is sealed in a gas-tight manner—for example by means of a switchable seal 60—against the environment, so that the container accommodation aperture 20 of the treatment chamber 2 is sealed in a gas-tight manner against the environment when a container 120 is pushed into it.

The container 120 is thus accommodated in a sealing manner by the treatment chamber 2. In an alternative embodiment, not only a portion of the container 120—such as the mouth area, as in the embodiment that is shown—but the entire container 120 can be accommodated in the treatment chamber 2.

The treatment chamber 2 also has at its upper end a capper accommodation aperture 22. Through the capper accommodation aperture 22, the closing device 4, or a closing element 40 of the closing device 4, can act upon the container mouth 122 of a container 120 that has been filled, in order to attach a container closure. By means of the lowering of the closing device 4 and a capper flange 42 of the closing device 4, the capper accommodation aperture 22 can be sealed against the environment in a gas-tight manner.

Accordingly, by the introduction of the container 120 into the container accommodation aperture 20, and by the lowering of the closing device 4 onto the capper accommodation aperture 22, the interior of the treatment chamber 2 can be closed in a gas-tight manner against the environment. Within the treatment chamber 2, a pressure that differs from the ambient pressure can thus be applied, and/or an atmosphere or gas mixture or gas that differs from the surrounding atmosphere can be provided in the treatment chamber 2.

In the treatment chamber 2, for example, by means of the creation of an overpressure, a pressure that differs from that of the environment can be provided. This pressure is achieved in the treatment chamber 2, and hence also in the interior of the container 120 to be filled, which is closed in a gas-tight manner with the treatment chamber 2 against the environment, when the unsealed container mouth 122 protrudes into the treatment chamber 2 and the interior of the container is thus in communication with the treatment chamber 2.

By means of the pressurization of the treatment chamber 2 with a gas or a gas mixture, for example by feeding in $CO_2$ or another inert gas via a pressurization gas channel 84 which is in communication with the treatment chamber 2, an atmosphere that differs from that of the environment can be provided in the treatment chamber 2.

In the treatment chamber 2, a filling product outlet 30 of the filling device 3 is provided, by means of which the filling product that is to be filled can be dispensed into the interior of the container 120 that is to be filled. The filling device 3 has a filling product outlet seal 300 surrounding the filling product outlet 30, onto which the mouth 122 of the container 120 can be pressed, and by means of which a sealed connection can be created between the interior of the container and the filling device 3.

If the open container mouth 122 opens into the treatment chamber 2, in the interior of the container 120, which is closed with the treatment chamber 2 against the environment in a gas-tight manner, substantially the same pressure and substantially the same atmosphere is provided as in the treatment chamber 2.

If, on the other hand, the container mouth 122 of the container 120 that is to be filled is closed off from the treatment chamber 2 in a gas-tight manner, for example because the container mouth 122 is sealed by the filling device 3, the pressure that is present in the treatment chamber 2 and the atmosphere that is present in the treatment chamber 2 have no influence on the pressure that is present in the interior of the container 120 or the gas composition therein.

In the example embodiment that is shown, the filling device 3, and thus also the filling product outlet 30, can be displaced in the direction indicated by the arrow F, which indicates the direction of movement of the filling device, such that either the filling product outlet 30 is disposed over the container accommodation aperture 20 in a treatment position so that a container 120 to be filled can be charged through its container mouth 122 with the filling product that flows out of the filling product outlet 30, or else the filling device 3 and the filling product outlet 30 are displaced into a withdrawn standby position, such that the closing device 4 can attach a container closure, in a manner described below, to the container 120 which has then been filled.

The closing device 4 has a closing element 40, by means of which the actual container closure can be attached to the container 120, which is still accommodated in the treatment chamber 2 and has been filled but not yet capped. In the example embodiment that is shown, the closing element 40 is configured to attach a crown cork closure to the container 120 that is to be closed. The closing element 40 can however also be configured as necessary and according to the container closure that is required, and can in particular, alongside its configuration as a crown cork capper, also be configured as a screw capper for attaching a screw closure which is supplied as a molded part, or as a roll-on capper for rolling a container closure sleeve onto an external thread of a filled container, or as a closing element to attach stoppers or corks, or configured in any other manner to close the filled container 120.

As soon as the gas-tight seal between the filling product outlet 30 and the container 120 has been established, rinsing of the container can take place, using a rinsing gas, for example $CO_2$, which is supplied via a rinsing gas channel 80. A vacuum channel 88 can generally also be provided, by means of which an underpressure can be applied to the container 120. In this manner, a flow of rinsing gas can pass through the container 120 and thereby displace the residual oxygen in the container 120. Alternatively, efficient rinsing of the container 120 can be achieved by alternating application of underpressure and rinsing gas.

In the rinsing gas channel 80, an absolute pressure of 0.5 bar to 4 bar is generally present. The pressure that is present in the container 120 must therefore be maintained, by means of the switching of the vacuum channel 88, at a pressure below the pressure in the rinsing gas channel 80 if the inflow of the rinsing gas into the container 120 is to be enabled.

A control system 9 serves to switch a rinsing gas valve 82 and a vacuum valve 89 such that the container 120 is rinsed with the rinsing gas in the manner described above, and accordingly a predetermined concentration of rinsing gas is achieved in the container 120. By this means, for example, a low oxygen atmosphere can be achieved in the container 120.

The filling product can then be introduced into the rinsed container 120. In certain embodiments, prior to the introduction of the filling product either an underpressure can be provided in the container 120, into which the filling product, which is then at a relative overpressure, is introduced, or else the container 120 is pre-pressurized with a pressurization gas to a pressure which is above the saturation pressure of the filling product, and the filling product is introduced into the pre-pressurized container 120.

In addition, if the treatment chamber 2 is sealed in a pressure-tight manner against the container 120 by the filling device 3 being pressed onto the container 120, the treatment chamber 2 is pre-pressurized with a pressurization gas via a pressurization gas channel 84. The control system 9 controls this pressurization of the treatment chamber 2 with the pressurization gas by means of the appropriate switching of a pressurization gas valve 86.

In order efficiently to achieve both the rinsing effect of the rinsing gas and the pre-pressurization effect of the pressurization gas, the rinsing gas channel 80 is generally at an absolute pressure of 0.5 bar to 4 bar, for example at an absolute pressure of 1.4 bar to 1.9 bar, and the pressurization gas channel 84 is at an absolute pressure of 2 bar to 11 bar, for example at an absolute pressure of 5 bar to 9 bar.

In some embodiments of the method, the rinsing gas channel 80 is at an absolute pressure of approximately 1.7 bar, and the pressurization gas channel 84 is at an absolute pressure of approximately 7 bar.

In order efficiently to achieve both the rinsing effect of the rinsing gas and the pre-pressurization effect of the pressurization gas, the pressurization gas channel 84 is also at a higher pressure than the rinsing gas channel 80.

If the desired pre-pressurization pressure has been achieved in the treatment chamber 2 and the container 120 has been filled, the filling device 3 can be lifted off of the mouth 122 of the container 120. The treatment chamber 2 is then in communication with the container 120, and as a result of this the pre-pressurization pressure in the treatment chamber 2 is then applied to the interior of the container 120 and the filling product that is present within it. In this manner, it is possible to reduce or prevent the foaming over of the filling product due to the release of the gas—for example $CO_2$—that is bound in the filling product when the filling device 3 is lifted off.

Figure 2:
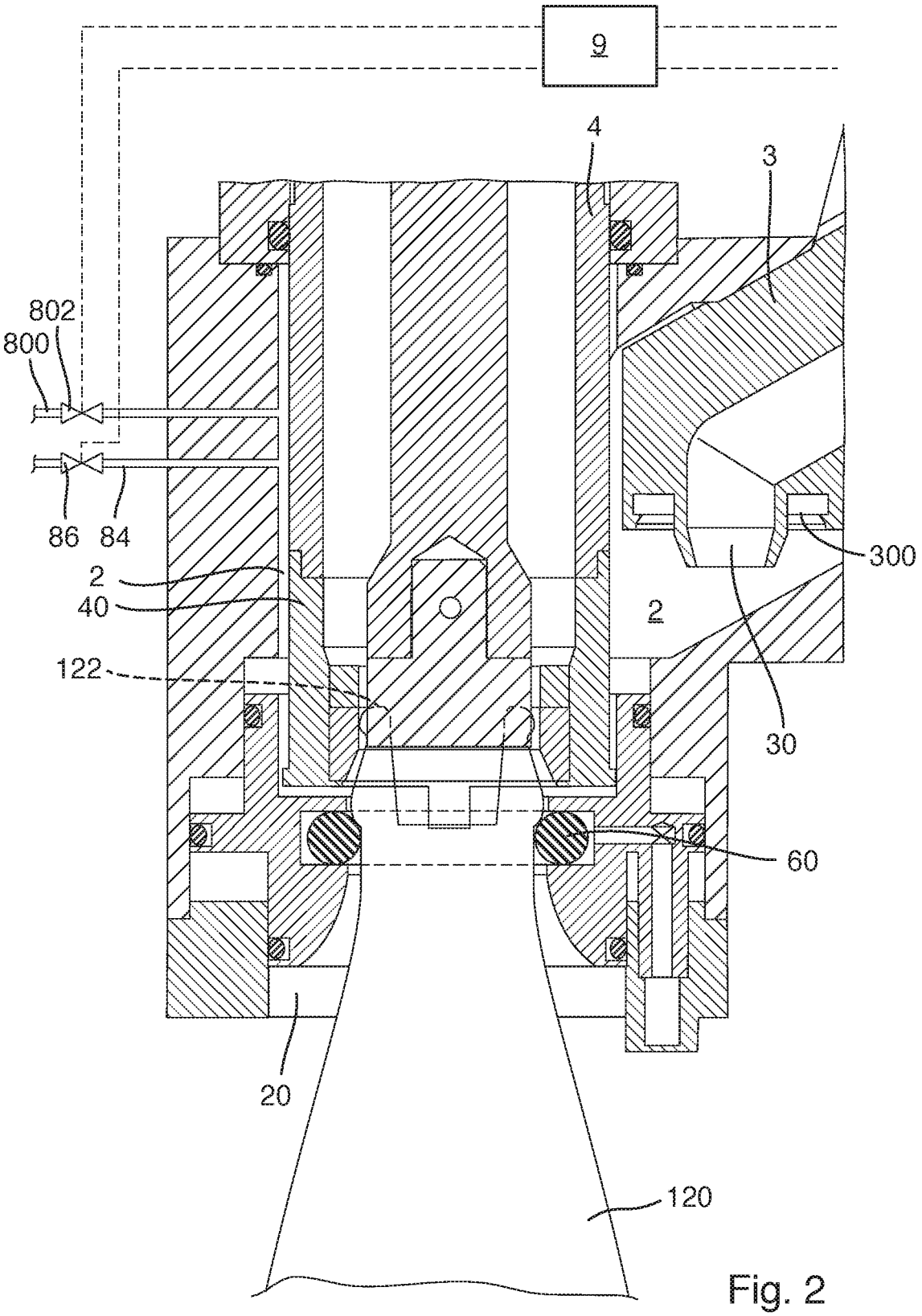
FIG. 2 is a schematic representation of the device from FIG. 1, wherein the closing element has been guided over the mouth area of the filled container, in order to attach a container closure to the filled container.

The filling device 3 is subsequently withdrawn in the direction of movement of the filling device F, and the closing device 4 is lowered, as shown schematically in FIG. 2, in order to attach a closure to the mouth 122 of the then filled container 120. During this entire process, the container 120, i.e. the interior of the container, is in communication with the treatment chamber 2, which is itself under the pre-pressurization pressure.

After the closing of the container 120, the pressure in the treatment chamber 2 is relieved to a lower pressure by the opening of the rinsing gas channel 80 by means of the rinsing gas valve 82. Because the rinsing gas channel 80 is at a low pressure, for example, in one embodiment, at an absolute pressure of 1.7 bar, the gas that is present in the treatment chamber 2 at a high pressure, for example at an absolute pressure of 7 bar in this example embodiment, flows back into the rinsing gas channel 80 when the rinsing gas valve 82 is opened. Accordingly, at least a portion—depending on the pressure conditions—of the pressurization gas that is present in the treatment chamber 2 will flow back into the rinsing gas channel 80.

In the example embodiment that is shown, the treatment chamber 2 is in communication with the filling device 3 even when the latter is withdrawn, and is in particular also in contact via the filling product outlet 30 with the rinsing gas channel 80 and the vacuum channel 88.

With certain pressure conditions, full relief of the pressure in the treatment chamber 2 to ambient pressure cannot take place via the rinsing gas channel 80 only. In this case, full relief of the pressure in the treatment chamber 2 to ambient pressure can be achieved for example by means of a connection of the treatment chamber 2 with the vacuum channel 88.

Alternatively, or in addition, relief of the pressure in the treatment chamber 2 to ambient pressure can also, or additionally, be achieved via a pressure relief channel 800 which is in communication with the environment.

As a further alternative to, or in addition to, one or both of the above-mentioned possible means of relieving the pressure in the treatment chamber 2, subsequent to the relief of the pre-pressurization pressure in the treatment chamber 2 into the rinsing gas channel 80, the residual pre-pressurization pressure in the treatment chamber 2 can be further relieved, for example to ambient pressure, by withdrawing the filling device 3 and/or the closing device 4 from the treatment chamber 2.

Subsequent to the relief of the pressure in the treatment chamber 2 into the rinsing gas channel 80, the rinsing gas valve 82 is again closed and the closing element 40 is then moved out of the treatment chamber 2. The resultant increase in volume of the free volume in the treatment chamber 2 also effects a relief of the pre-pressurization pressure that is still present in the treatment chamber 2. This withdrawal can continue until the pressure is relieved to ambient pressure. The filled and closed containers can then be removed from the treatment chamber 2.

The respective processes are controlled via the control system 9, which serves to switch the applicable valves, for example the pressurization gas valve 86 and/or the rinsing gas valve 82 and/or the vacuum valve 89 and/or the pressure relief valve 802.

Figure 3:
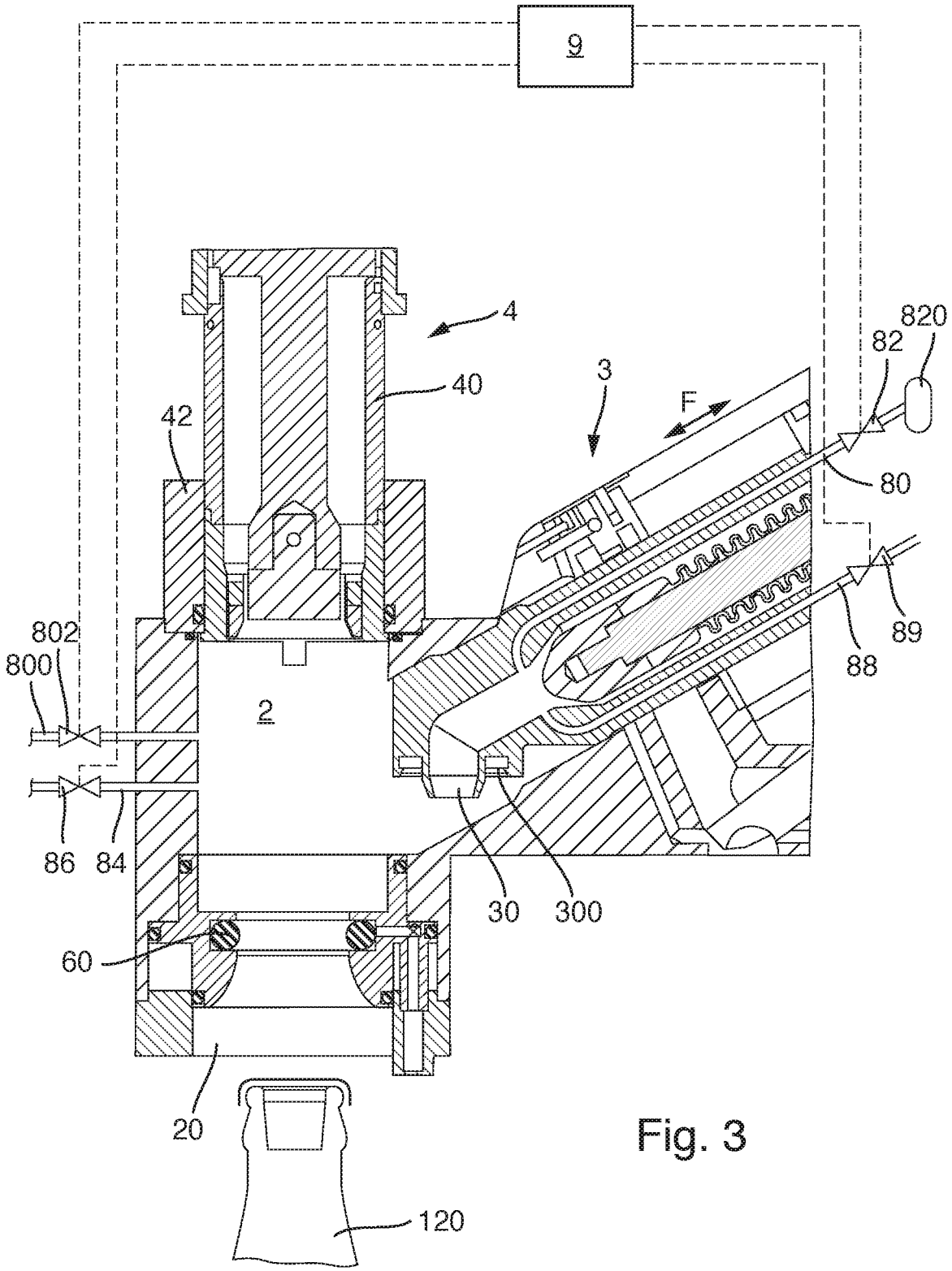
FIG. 3 is a schematic representation of the device from the previous figures, wherein the closing element has been withdrawn back to its initial position, and the filled and closed container has been conveyed out of the treatment chamber in a downwards direction.

After the pressure in the treatment chamber 2 has reached ambient pressure, the filled and closed containers 120 can be removed from the treatment chamber 2, as shown schematically in FIG. 3.

When rinsing again takes place of a subsequent container 120 to be filled which is accommodated in the treatment chamber 2, the pressurization gas which has flowed back into the rinsing gas channel 80, and now functions as rinsing gas, is reused as such. The pressurization gas which has flowed back is stored in the interim in the rinsing gas channel 80. The volume of the rinsing gas channel 80 is designed accordingly, and can for example be extended by an intermediate pressure reservoir.

The volume of pressurization gas which has flowed back into the rinsing gas channel 80 may be insufficient for the next rinsing of a further container 120 to be filled. In this case, fresh rinsing gas can be supplied from a rinsing gas source 820—for example a rinsing gas tank. The use of the pressurization gas which has flowed back into the rinsing gas channel 80 as rinsing gas makes it possible, however, to reduce the consumption of fresh rinsing gas.

The rinsing gas channel 80 is generally designed such that the entire volume of pressurization gas that flows back can be accommodated in the rinsing gas channel 80, without the pressurization gas that flows back entering the rinsing gas source 820. This is in order to exclude the possibility of contamination.

To the extent applicable, all individual features described in the example embodiments can be combined with each other and/or exchanged, without departing from the field of the invention.

The invention claimed is:

1. A method for filling a container to be filled with a filling product, comprising:

accommodating the container in a treatment chamber;

sealing a filling device to the container;

subsequent to the sealing of the filling device to the container, rinsing the container with a rinsing gas introduced into the container through a rinsing gas channel;

subsequent to the rinsing of the container with the rinsing gas, filling the container with the filling product;

pre-pressurizing the treatment chamber with a pressurization gas through a pressurization gas channel, wherein the pressurization gas channel is distinct from the rinsing gas channel;

subsequent to the filling of the container and the pre-pressurization of the treatment chamber, removing the filling device from the container;

subsequent to the removal of the filling device from the container, closing the container with a container closure; and subsequent to the closing of the container, relieving the pre-pressurization pressure in the treatment chamber and removing the container from the treatment chamber, wherein the pre-pressurization pressure that is present in the treatment chamber is at least in part relieved into the rinsing gas channel.

2. The method of claim 1, further comprising subsequent to the relief of the pre-pressurization pressure in the treatment chamber into the rinsing gas channel, relieving residual pre-pressurization pressure in the treatment chamber through a pressure relief channel that is in communication with an environment.

3. The method of claim 2, wherein the residual pre-pressurization pressure is relieved to ambient pressure.

4. The method of claim 1, further comprising subsequent to the removal of the closed container, rinsing a subsequent container to be filled that is accommodated in the treatment chamber with at least a portion of the pressurization gas that was relieved into the rinsing gas channel.

5. The method of claim 4, further comprising rinsing the subsequent container with a rinsing gas from a rinsing gas source.

6. The method of claim 1, wherein the rinsing gas channel is at an absolute pressure of 0.5 bar to about 4 bar, and the pressurization gas channel is at an absolute pressure of 2 bar to about 11 bar.

7. The method of claim 6, wherein the rinsing gas channel is at an absolute pressure of 1.4 bar to about 1.9 bar, and the pressurization gas channel is at an absolute pressure of 5 bar to about 9 bar.

8. The method of claim 1, wherein the pressurization gas channel is at a higher pressure than the rinsing gas channel.

9. The method of claim 1, further comprising subsequent to the relief of the pre-pressurization pressure that is present in the treatment chamber into the rinsing gas channel, supplying an underpressure via a vacuum line to further relieve residual pre-pressurization pressure in the treatment chamber.

10. The method of claim 1, further comprising subsequent to the relief of the pre-pressurization pressure that is present in the treatment chamber into the rinsing gas channel, withdrawing the filling device or a closing device from the treatment chamber to further relieve residual pre-pressurization pressure in the treatment chamber.

11. The method of claim 1, further comprising subjecting the container to an underpressure provided via a vacuum line during introduction of the rinsing gas into the container.

12. The method of claim 1, further comprising applying an underpressure to the container prior to introduction of the filling product into the container and introducing a filling product at an overpressure into the container.

13. A device for filling a container to be filled with a filling product, comprising:

a treatment chamber configured to accommodate the container to be filled in a sealing manner;

a filling device configured to be applied in a sealing manner to the container that is sealed in the treatment chamber and to introduce the filling product into the container;

a rinsing gas channel configured to introduce a rinsing gas into the container;

a pressurization gas channel configured to introduce a pressurization gas into the treatment chamber, wherein the pressurization gas channel is distinct from the rinsing gas channel;

a closing device configured to attach a container closure to a filled container inside the treatment chamber; and a control system configured to relieve at least partially a pre-pressurization pressure in the treatment chamber into the rinsing gas channel subsequent to the closing of the container.

14. The device of claim 13, wherein the control system is further configured to, subsequent to the relief of the pre-pressurization pressure in the treatment chamber into the rinsing gas channel, relieve residual pre-pressurization pressure in the treatment chamber through a pressure relief channel that is in communication with an environment.

15. The device of claim 14, wherein the control system is configured to relieve the residual pre-pressurization pressure in the treatment chamber to ambient pressure.

16. The device of claim 13, wherein the control system is further configured to, subsequent to the relief of the pre-pressurization pressure in the treatment chamber into the rinsing gas channel, relieve residual pre-pressurization pressure in the treatment chamber by supplying an underpressure provided via a vacuum line.

17. The device of claim 13, wherein the control system is further configured to, subsequent to the relief of the pre-pressurization pressure in the treatment chamber into the rinsing gas channel, relieve residual pre-pressurization pressure in the treatment chamber by withdrawing the filling device or the closing device from the treatment chamber.

18. The device of claim 13, wherein the control system is further configured to, subsequent to a removal of a closed container, rinse a subsequent container to be filled that is accommodated in the treatment chamber.

19. The device of claim 18, wherein the control system is configured to rinse the subsequent container at least in part with the pressurization gas that has been relieved into the rinsing gas channel.

20. The device of claim 18, wherein the control system is further configured to rinse the subsequent container with a rinsing gas from a rinsing gas source.

* * * * *